US005884675A

United States Patent [19]

Krasnov

[11] Patent Number: 5,884,675

[45] Date of Patent: Mar. 23, 1999

[54] CASCADE SYSTEM FOR FUELING COMPRESSED NATURAL GAS

[76] Inventor: Igor Krasnov, 6835 Oakwood Trace Ct., Houston, Tex. 77040

[21] Appl. No.: 842,415

[22] Filed: Apr. 24, 1997

[51] Int. Cl.[6] ..... B65B 1/04

[52] U.S. Cl. ..... 141/18; 141/3; 141/231

[58] Field of Search ..... 141/2, 3, 4, 5, 141/18, 21, 83, 231

[56] References Cited

U.S. PATENT DOCUMENTS

| | | | |
|---|---|---|---|
| 5,107,906 | 4/1992 | Swenson et al. | 141/11 |
| 5,253,682 | 10/1993 | Haskett et al. | 141/231 |
| 5,685,350 | 11/1997 | Chowdhury | 141/231 |

*Primary Examiner*—David J. Walczak
*Attorney, Agent, or Firm*—James E. Bradley

[57] ABSTRACT

A compressed natural gas (CNG) vehicle refueling system has a hydraulic fluid reservoir, an accumulator, and two banks of cylinders, each of which has an axially moveable piston, a pair of inlets and an outlet. The pistons separate the CNG from hydraulic fluid. The refueling system drains the banks one at a time by refueling CNG vehicles with a plurality of refueling depots. Hydraulic fluid is pumped from reservoir to the cylinders to maintain 3600 psi of pressure in the cylinders while CNG is being dispensed. A pressure limiting valve limits pressure in the vessel tanks to 3000 psi. When the bank is drained of CNG, the pistons stop moving, the pressure at the outlets drops below 3000 psi, and the pressure at the inlets increases. This difference in pressure is sensed, causing the control panel to change banks. The pressure in the accumulator and the lack of pressure in the reservoir causes the hydraulic fluid to return to the reservoir. The second bank simultaneously begins to dispense CNG in the same manner as the first bank.

16 Claims, 2 Drawing Sheets

CASCADE SYSTEM FOR FUELING COMPRESSED NATURAL GAS

TECHNICAL FIELD

This invention relates in general to natural gas vehicles and in particular to natural gas vehicle fuel delivery systems.

BACKGROUND ART

Compressed natural gas (CNG) vehicles require specialized refueling delivery systems. One such system utilizes high pressure storage vessels or bottles which are delivered full to a dispensing or filling station on shuttle trucks. A hose from the storage vessel is connected to the tank on the vehicle to be refueled, allowing CNG to flow from the storage vessel to the tank. A high pressure compressor applies pressure to the vessels as the CNG fuel flows to the vehicles. The compressor is required to compensate for pressure drops in the vessels resulting from dispensing the CNG.

This system has several disadvantages. The compressor is very expensive and usually represents a significant portion of the cost of the filling station. The compressor is also noisy, it requires regular maintenance and the system is inefficient. The compressor can only unload approximately 50% of the CNG contained within the high pressure vessels due to its fixed compression ratio.

Another CNG refueling system consists of equipping the filling stations with hydraulic power units (HPU). The shuttle trucks carrying CNG in pressure vessels are connected to a hydraulic system. The pressure vessels have an internal piston which is pressurized by hydraulic fluid. The piston also separates the hydraulic fluid from the CNG. HPU pumps are used to maintain pressure in the vessels as CNG is dispensed.

This type of system also has several disadvantages. The pressure vessels require large volumes of hydraulic fluid from a large hydraulic fluid reservoir. The large quantity of hydraulic fluid requires significant power handling capabilities, it must be preheated in colder climates, and it poses a more serious pollution hazard. Once the vessels are filled with hydraulic fluid, a significant amount of time is required to drain the vessels.

DISCLOSURE OF THE INVENTION

A compressed natural gas (CNG) vehicle refueling system has a hydraulic fluid reservoir containing hydraulic fluid, two pumps and reversible flow valves. The refueling system also has two banks of cylinders each of which has an axially moveable piston, a pair of inlets and an outlet. The pistons separate the CNG from the hydraulic fluid. Each bank also has an accumulator located downstream from the outlets. The accumulators and cylinders are pressure storage vessels which will be initially pressurized to 3600 psi with CNG. The cylinders are filled with CNG at a remote location and then transported to the refueling system. The refueling system refuels CNG vehicles with a plurality of refueling depots.

The banks are drained one at a time. The control panel configures one of the reversible flow valves for downstream flow and the other is closed so that one of the banks is not pressurized. Hydraulic fluid is pumped from the reservoir to the cylinders to maintain 3600 psi of pressure in the cylinders while CNG is being dispensed. The CNG flows through the outlets and refueling depots to the vehicles being refueled. A hose line control valve prevents pressure in the vehicle tank from exceeding 3000 psi.

When the bank is completely drained of CNG, the pistons stop moving, the pressure at the outlets drops below the pressure at the inlets. Pressure sensors provide this information to the control panel. This combination of signals causes the control panel to reverse the orientation of the reversible flow valves. The pressure in the accumulator coupled with the lack of pressure in the reservoir causes the pistons to move back to their starting position, thereby causing the hydraulic fluid in the bank to return to the reservoir. The second bank simultaneously begins to dispense CNG in the same manner as the first bank. The first bank is now ready to be refilled with CNG. After all of the banks on a trailer are empty, a shuttle truck returns them to a remote location for refilling.

BEST MODE FOR CARRYING OUT THE INVENTION

Figure 1:
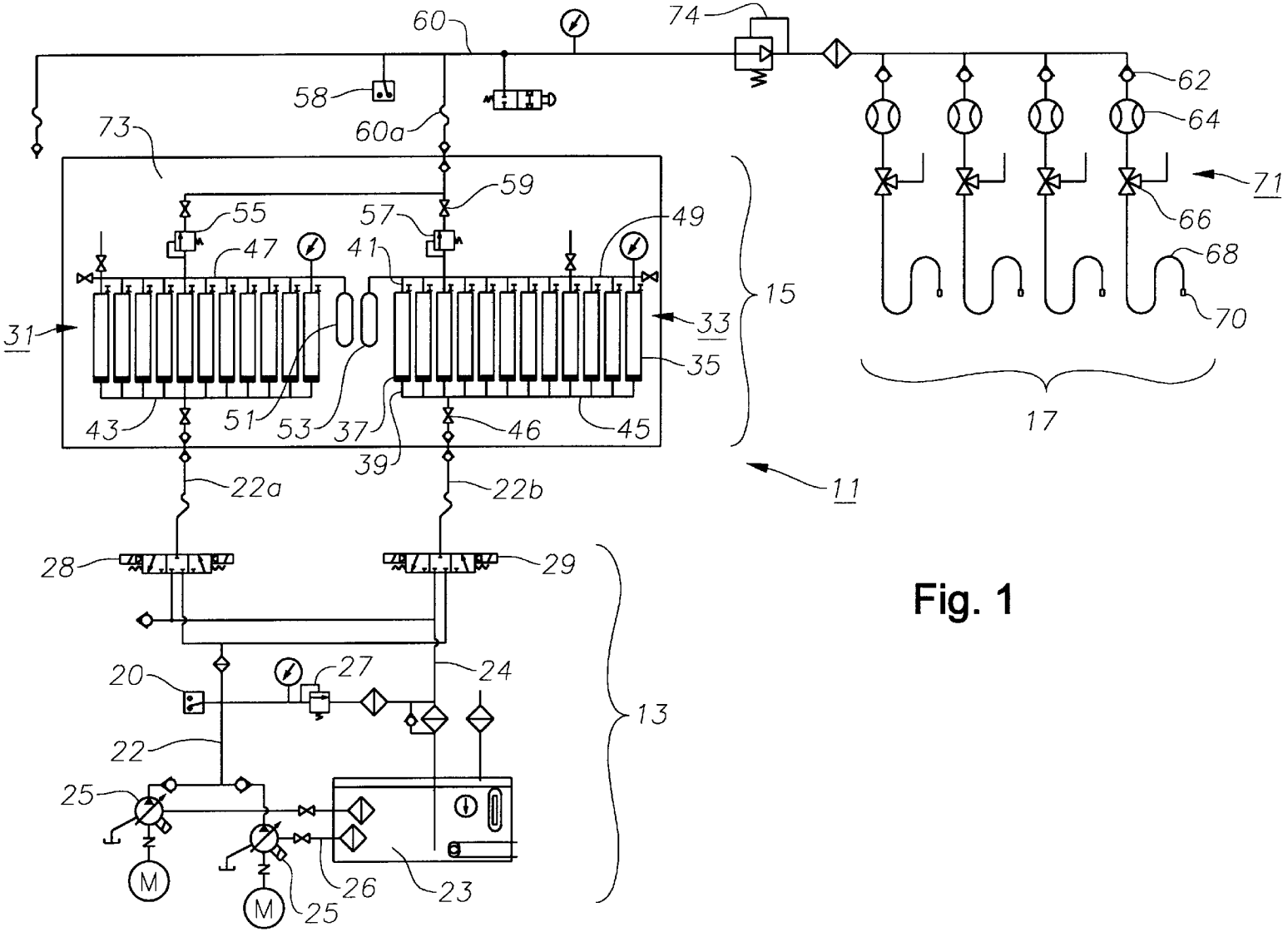
FIG. 1 is a schematic diagram of a compressed natural gas vehicle refueling system constructed in accordance with the invention.

Referring to FIG. 1, a compressed natural gas (CNG) vehicle refueling system 11 is shown. Refueling system 11 is divided into a control section 13, a transfer section 15 and a refueling section 17. Control section 13 has a computerized control panel (not shown) and a hydraulic fluid reservoir 23 containing hydraulic fluid. Control section 13 also has at least two parallel, hydraulic fluid pumps 25 and reversible flow valves 28, 29. Flow valves 28, 29 are three-position valves having a closed position, a return flow position, and a forward flow position. Reservoir 23 has an outlet line 26 leading to each of the pumps 25. The output of pumps 25 is combined into a single outlet line 22 which leads to flow valves 28, 29. Outlet line 22 has two hoses 22*a*, 22*b*, with flow valve 28 connected to hose 22*a* and flow valve 29 connected to hose 22*b*. A pressure sensor 20 monitors pressure in line 22 and provides a signal to control section 13. A relief valve 27 is set to prevent pressure in excess of 3600 psi by bleeding the excessively pressurized fluid back into reservoir 23. A return line 24 extends from flow valves 28, 29 to reservoir 23.

Transfer section 15 comprises two banks 31, 33, each of which has a plurality of high pressure storage cylinders 35. Banks 31, 33 contain an equal number of cylinders 35 which are identical in size. The volume capacity of reservoir 23 is about 20% greater than the volume capacity of one of banks 31, 33.

Figure 2:
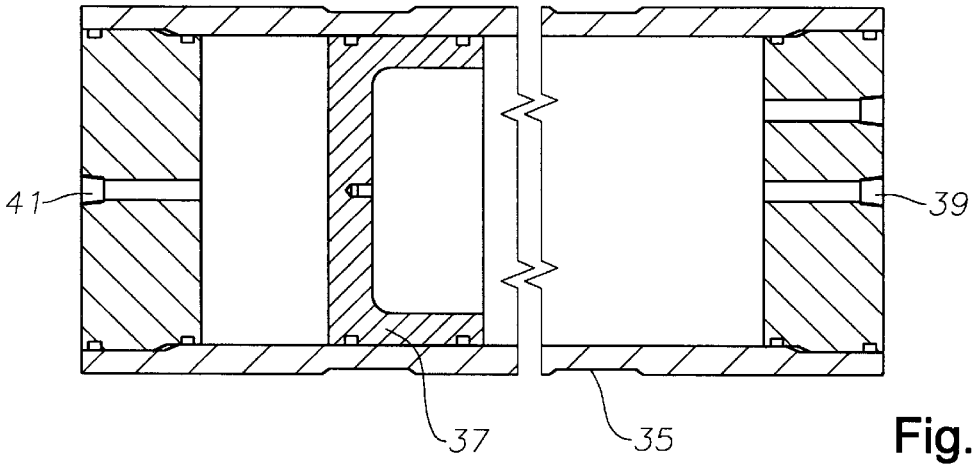
FIG. 2 is an enlarged sectional side view of a cylinder and piston of FIG. 1.

Referring to FIGS. 1 and 2, each cylinder 35 has an axially moveable separator or piston 37, a pair of inlets 39 on one end and an outlet 41 on the other end. Pistons 37 separate the CNG from the hydraulic fluid. Cylinders 35 are filled with CNG at a remote location and then transported to refueling system 11. When cylinders 35 are filled with CNG (FIG. 1), pistons 37 are adjacent to inlets 39. In the preferred embodiment, each cylinder 35 initially contains 3600 psi of CNG.

As shown in FIG. 1, the inlets 39 of cylinders 35 in each bank 31, 33 are joined together in parallel by inlet manifolds 43, 45, respectively. Reversible flow valves 28, 29 are located between pumps 25 and manifolds 43, 45, respectively. Each inlet manifold 43, 45 has a manual shut-off valve 46. The outlets 41 of each cylinder 35 in banks 31, 33 are joined together in parallel by outlet manifolds 47, 49, respectively. Each bank 31, 33 also has an accumulator 51, 53, and a pressure control valve 55, 57, respectively. Accumulators 51, 53 and pressure control valves 55, 57 are located downstream from outlets 41 in parallel. Accumulators 51, 53 are pressure storage vessels which will also be initially pressurized to 3600 psi with CNG. Accumulators 51, 53 are separate from and smaller than the individual cylinders 35 and are connected to outlet manifolds 47, 49, respectively. Accumulators 51, 53 do not contain any moveable members such as pistons 37. Valves 55, 57 allow CNG to flow downstream from outlet manifolds 47, 49 through a flexible hose 60*a* to a hose line 60 unless the pressure drops below 3000 psi. Each outlet manifold 47, 49 has a manual shut-off valve 59 located on the downstream side of pressure control valves 55, 57, respectively. A pressure sensor 58 senses pressure in hose line 60 and provides a signal to the computer in control section 13. If the pressure in hose line 60 drops below the pressure in line 22 sensed by sensor 20, control panel 13 shifts valves 28, 29. A flow control valve 74 in hose line 60 is located downstream from pressure sensor 58 and valves 59.

Figure 3:
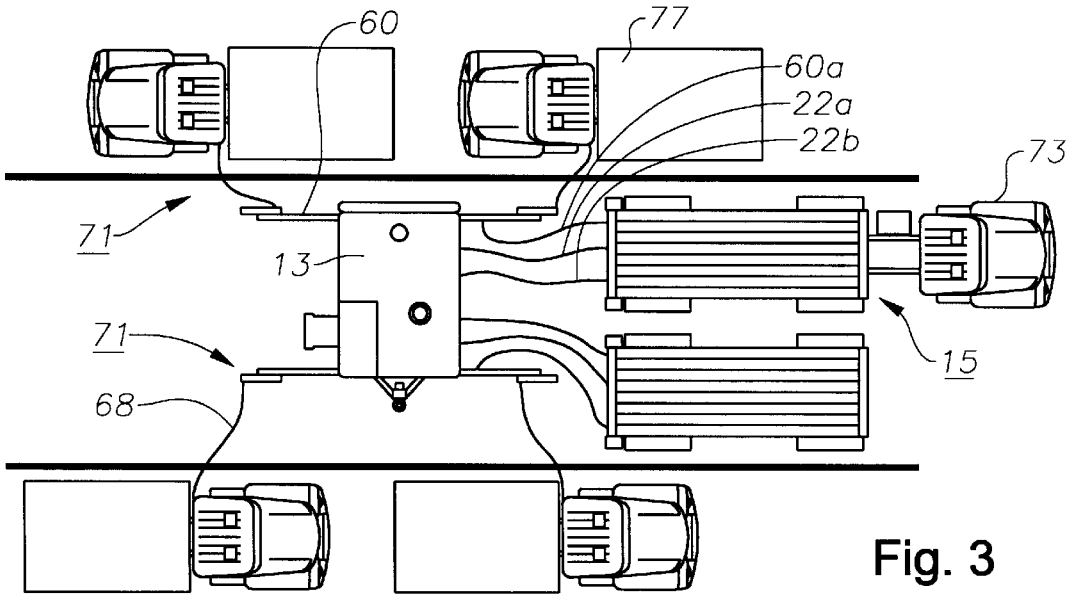
FIG. 3 is a schematic drawing of the refueling system of FIG. 1 during refueling.

Referring also to FIGS. 1 and 3, refueling section 17 comprises a plurality of refueling depots 71, each of which may refuel one vehicle 77 at a time. FIG. 3 shows two sets of refueling depots 71, although only one is shown in FIG. 1. Each refueling depot 71 has a check valve 62, and an optional flow meter 64. Each refueling depot 71 also has a driver-operated dispensing valve 66, a flexible hose 68 and a nozzle 70 for engaging the fuel tank of the vehicle 77 to be refueled. Flow control valve 74 limits the CNG dispensing pressure in hose 68 to a maximum of 3000 psi.

In operation, refueling system 11 is supplied with CNG by banks 31, 33 which are transported by shuttle trucks 73 (FIG. 3). Each truck 73 may contain more than one bank 31, 33 of cylinders 35, and preferably contains at least two as shown. The inlet manifolds 43, 45 of banks 31, 33 are connected to hydraulic lines 22*a*, 22*b*, and outlet manifolds 47, 49 are connected to hose line 60 via hose 60*a*. Banks 31, 33 are drained one at a time. If bank 31 is drained first, its manual valves 46, 59 will be opened (FIG. 1). The control panel in control section 13 configures reversible flow valve 28 for downstream flow to inlet manifold 43 and flow valve 29 is closed so that bank 33 is not pressurized by hydraulic fluid pressure. Manual valves 46, 59 for bank 33 may remain open even though hydraulic pressure is not being applied since control valve 57 stops any outflow from bank 33 below 3000 psi. Hydraulic fluid is pumped by pumps 25 from reservoir 23 into inlet manifold 43, through inlets 39, and into cylinders 35 to maintain pressure at 3600 psi in cylinders 35 while CNG is being dispensed. The CNG flows through outlets 41, outlet manifold 47, valves 55, 74 and out hose 68 to the vehicles being refueled. Flow control valve 74 limits the pressure in hoses 68 to 3000 psi.

A maximum of one vehicle 77 can be refueled at each fuel depot 71 simultaneously. As vehicles 77 are refueled, the CNG in bank 31 flows through manifold 47 while accumulator 51 remains pressurized. While bank 31 contains CNG, the pressure in refueling system 11 from pumps 25 to flow control valve 74 will be between 3000 and 3600 psi. During refueling, the pressure in line 22 is approximately equal to the pressure in hose line 60. When refueling is completed, dispensing valve 66 is closed and nozzle 70 is disconnected from the tank of vehicle 77.

When pistons 37 reach outlets 41, the pressure at manifold 47 drops below 3000 psi. Flow control valve 55 closes. The pressure at and upstream from manifold 43 will be higher because pumps 25 will continue operating. The pressure in hose line 60 will be below 3000 psi as monitored by sensor 58, and less than the pressure in line 22 as monitored by sensor 20. This difference of signals causes the control panel to reverse the orientation of flow valves 28, 29. Flow valve 28 will now only permit return flow, while flow valve 29 will only permit downstream flow to inlet manifold 45. The pressure in accumulator 51 coupled with the lack of pressure in reservoir 23 causes pistons 37 to move back toward manifold 43, thereby causing the hydraulic fluid in bank 31 to return to reservoir 23 through return line 24. Only a few seconds are required to return the hydraulic fluid to reservoir 23. Since flow valve 29 is now configured for downstream flow, bank 33 simultaneously begins to dispense CNG in the same manner as bank 31. Flow control valve 57 opens as the pressure will exceed 3000 psi once pumps 25 begin pumping hydraulic fluid into inlets 45. After both banks 31, 33 are empty, a shuttle truck 73 returns them to the remote location for refilling. Another set of banks will be connected in this place.

The invention has several advantages. Since the system has no compressor at the filling station, it can unload almost 100% of the compressed natural gas contained within the high pressure vessels. The system utilizes cascades of pressure vessels which are configured to require a much smaller volume of hydraulic fluid than conventional systems. Since the working pressure of 3600 psi is greater than the dispensing pressure of 3000 psi, the working pressure can temporarily drop 600 psi and still dispense CNG. This feature allows the system to fill a number of vehicles simultaneously and one after another without a delay in refueling.

While the invention has been shown in only one of its forms, it should be apparent to those skilled in the art that it is not so limited, but is susceptible to various changes without departing from the scope of the invention.

I claim:

1. In a fuel delivery system for delivering compressed natural gas into a vehicle, comprising:

a reservoir containing hydraulic fluid and having a pump intake line and a return line;

at least one bank of cylinders for storing and dispensing gas, each of the cylinders having an inlet, an outlet and a moveable separator for separating the hydraulic fluid from the gas, the inlets being connected in parallel to each other and the outlets being connected in parallel to each other;

a hose line connected to the outlets for connection to a vehicle;

a pump connected to the pump intake line for pumping hydraulic fluid from the reservoir to the inlets to move the separators to maintain a selected minimum pressure at the outlets while the gas flows from the outlets through the hose line and into the vehicle;

an accumulator for accumulating a pressurized return gas, the accumulator being external of at least one of the cylinders and connected to the outlets; and valve means for closing the pump intake line and opening the return line to allow the return gas to force the separators to move to push the hydraulic fluid back through the inlets and return line and into the reservoir after the cylinders have been substantially depleted of gas.

2. The fuel delivery system of claim 1 wherein the at least one bank of cylinders comprises two of the banks of cylinders, the inlets and outlets of each bank of cylinders being independently connected in parallel, respectively.

3. In a fuel delivery system for delivering compressed natural gas into a vehicle, comprising:

a reservoir containing hydraulic fluid and having a pump intake line and a return line;

at least one bank of cylinders for storing and dispensing gas, each of the cylinders having an inlet, an outlet and a moveable separator for separating the hydraulic fluid from the gas, the inlets being connected in parallel to each other and the outlets being connected in parallel to each other;

a hose line connected to the outlets for connection to a vehicle;

a pump connected to the pump intake line for pumping hydraulic fluid from the reservoir to the inlets to move the separators to maintain a selected minimum pressure at the outlets while the gas flows from the outlets through the hose line and into the vehicle;

an accumulator for accumulating a pressurized return gas, the accumulator being connected to the outlets; and valve means for closing the pump intake line and opening the return line to allow the return gas to force the separators to move to push the hydraulic fluid back through the inlets and return line and into the reservoir after the cylinders have been substantially depleted of gas; and wherein the at least one bank of cylinders comprises two of the banks of cylinders, the inlets and outlets of each bank of cylinders being independently connected in parallel, respectively; and wherein the valve means selectively directs the hydraulic fluid being pumped to only one of the banks at one time.

4. The fuel delivery system of claim 1 wherein the separator comprises an axially moveable piston.

5. The fuel delivery system of claim 1 wherein the valve means comprises:

an outlet pressure sensor for sensing pressure in the hose line; and control means for closing the pump intake line and opening the return line when the pressure at the outlet pressure sensor drops below the pressure at the inlets.

6. The fuel delivery system of claim 1 wherein the accumulator is always in fluid communication with the outlets.

7. The fuel delivery system of claim 1 wherein the bank is mounted to a shuttle vehicle for returning the bank to a remote location for refilling after the bank has been depleted.

8. The fuel delivery system of claim 1, further comprising:

a relief valve for limiting the pump outlet pressure to a selected maximum level; and a flow control valve for limiting the pressure in the hose line to a selected maximum level.

9. A fuel delivery system for delivering compressed natural gas into a vehicle, comprising in combination:

a reservoir containing hydraulic fluid and having a pump intake line and a return line;

first and second banks of cylinders for storing and dispensing gas, each of the cylinders having an axially moveable piston, an inlet on an inlet end and an outlet on an outlet end, the inlets of each bank being connected in parallel to each other, respectively, and the outlets of each bank being connected in parallel to each other, respectively;

a pump connected to the pump intake line and having two pump outlet lines, each of which leads to the inlets of one of the banks, the pump being for pumping the hydraulic fluid from the reservoir to the inlets of the banks to force the pistons toward the outlet ends as the gas is being dispensed into the vehicle;

an inlet valve in each of the pump outlet lines;

a controller which controls the inlet valves for selectively directing the hydraulic fluid being pumped by the pump to only one of the banks at a time;

a hose line connected to both of the outlets for dispensing gas from the cylinders into the vehicles; and an accumulator connected to the outlets of each bank and being at a pressure that is the same as the pressure of the gas in the cylinders.

10. The fuel delivery system of claim 9 wherein the accumulator directs the hydraulic fluid in its respective one of the banks to flow through the return line back into the reservoir as gas pressure in the accumulator forces the pistons back to the inlet end.

11. The fuel delivery system of claim 9 wherein the reservoir has a volume capacity which is greater than a volume capacity of one of the banks but less than two of the banks.

12. The fuel delivery system of claim 9 wherein each inlet valve is also connected to the return line.

13. The fuel delivery system of claim 9, further comprising a hose line valve in the hose line, the hose line valve limiting the pressure on a downstream side of the hose line valve to a selected level that is less than an outlet pressure of the pump during dispensing.

14. A method for fueling compressed natural gas into a vehicle, comprising:

(a) mounting first and second banks of cylinders on a trailer, wherein each cylinder has an inlet, an outlet and a separator for separating hydraulic fluid from the gas;

(b) connecting the inlets and the outlets of each cylinder within each bank to each other in parallel, respectively;

(c) filling the first and second banks of cylinders with gas at a remote location and delivering the trailer with the cylinders to a refueling station;

(d) providing a hydraulic fluid reservoir and a hydraulic pump at the refueling station;

(e) at the refueling station, connecting the outlets of the first bank to a hose line and connecting the hose line to the vehicle;

(f) connecting a line from the hydraulic pump to the inlets of the first bank of cylinders;

(g) flowing gas from the first bank through the hose line to the vehicle;

(h) pumping hydraulic fluid with the hydraulic pump from the reservoir to the inlets of the first bank to move the separators in the cylinders in the first bank to displace gas being dispensed with hydraulic fluid;

(i) accumulating a pressurized return gas at the outlets of the first bank;

(j) after the gas has been substantially dispensed from the first bank, closing the outlets of the first bank and the hose line and supplying the return gas into the outlets of the first bank to force the separators of the cylinders of the first bank to push the hydraulic fluid back into the reservoir; and (k) repeating steps (e) through (j) for the second bank of cylinders.

15. The method of claim 14, further comprising sensing outlet pressure at the hose line and inlet pressure at the inlets of the first bank; and wherein step (g) occurs when the outlet pressure at the hose line becomes significantly less than the inlet pressure at the inlets of the first bank.

16. The method of claim 14 wherein steps (e) and (f) further comprise maintaining pump outlet pressure and inlet pressure of the inlets of the first bank at a level that is greater than the hose line pressure.

* * * * *